US008594362B2

(12) United States Patent
Liu

(10) Patent No.: US 8,594,362 B2
(45) Date of Patent: Nov. 26, 2013

(54) SPEAKER

(75) Inventor: Yu-Tsao Liu, Taipei (TW)

(73) Assignee: Reui Men Co., Ltd., New Taipei (TW)

( * ) Notice: Subject to any disclaimer, the term of this patent is extended or adjusted under 35 U.S.C. 154(b) by 0 days.

(21) Appl. No.: 13/342,342

(22) Filed: Jan. 3, 2012

(65) Prior Publication Data

US 2013/0148840 A1 Jun. 13, 2013

(30) Foreign Application Priority Data

Dec. 13, 2011 (TW) ..... 100145905 A

(51) Int. Cl.
*H04R 9/06* (2006.01)
*H04R 1/00* (2006.01)

(52) U.S. Cl.
USPC ..... 381/396; 381/431

(58) Field of Classification Search
USPC ..... 381/398, 340–350
See application file for complete search history.

(56) References Cited

U.S. PATENT DOCUMENTS

| | | | | |
|---|---|---|---|---|
| 6,516,071 | B1 * | 2/2003 | Liu | 381/152 |
| 2006/0088181 | A1 * | 4/2006 | Kaiya et al. | 381/398 |
| 2011/0075880 | A1 * | 3/2011 | Kamimura et al. | 381/413 |

* cited by examiner

*Primary Examiner* — Brian Ensey
*Assistant Examiner* — Norman Yu
(74) *Attorney, Agent, or Firm* — Turocy & Watson, LLP

(57) ABSTRACT

A speaker includes a base having a groove, a tube received in the groove, a magnet disposed in the tube, a first ring-shaped body and a washer mounted, from top to bottom, on an outer side of the tube sequentially, and a second ring-shaped body connected to an edge of the first ring-shaped body and installed around a wall surface of a rim of the groove. The second ring-shaped body has an inner ring-shaped plate, an outer ring-shaped plate, and a connection segment connected between the inner ring-shaped plate and the outer ring-shaped plate. Therefore, a low-frequency effect thus generated is greatly improved.

9 Claims, 7 Drawing Sheets

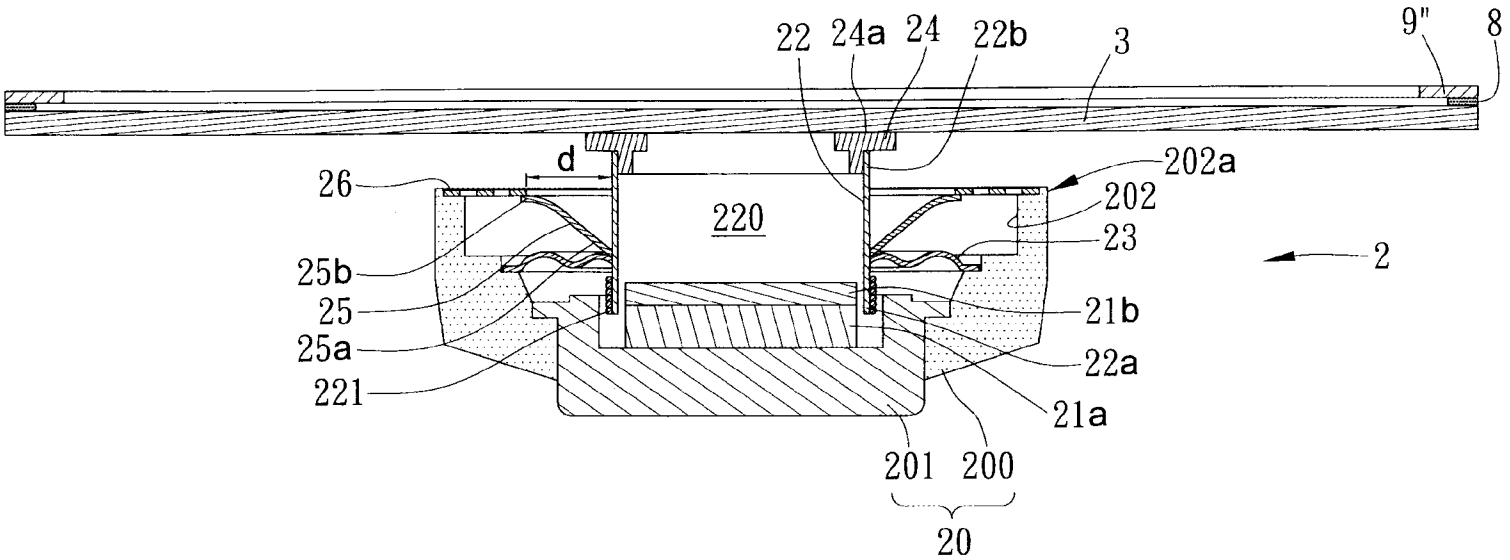
FIG. 3"

SPEAKER

BACKGROUND OF THE INVENTION

1. Field of the Invention

This invention relates to speakers, and, more particularly, to a speaker having improved tone quality.

2. Description of Related Art

Speakers transform current signals output from an amplifier into sound signals, and play a dominant role in the tone quality of a stereo. A flat panel speaker is commonly seen in the speaker market.

As shown in FIG. 1, a conventional flat panel speaker 1 has a tube 12 having a through hole 120 installed in a groove 102 of a base 10, a magnet 11 disposed on a bottom portion of the groove 102 and received in the through hole 120, a coil 121 winding tube 12 so that the tube 12 acts as a sound tube, and a wave-shaped outward extended bracing component 13 connected to the base 10 and an outer side of the tube 12 to support the tube. A washer 14 is mounted onto a top end of the tube 12. The washer 14 has a top surface that acts as a driving surface 14*a* that is to be adhered to a vibration plate 15. The flat panel speaker 1 works as follows. Signals output from an amplifier are input to the coils 121, and the coil 121 generates a magnetic field that interacts with the magnet 11. As a result, the tube 12 moves back and forth relative to the magnet 11, and the driving surface 14*a* of the washer 14 upwardly drives the vibration plate 15 to vibrate the air and to make sound.

However, the existing speakers, including the conventional flat panel speaker 1 or other types of speakers, transmit the tone quality to the medium- and high-frequency only, and can transmit slightly to the low-frequency. Therefore, the existing speakers have poor sound performance.

The above problem is solved by improving an outer structure such as an acoustic enclosure of an amplifier. However, the low-frequency effect of the amplifier with the improved outer structure still does not satisfy the users, and the outer structure thus improved has a high manufacturing cost.

Therefore, how to solve the problems of the convention techniques is becoming one of the most popular issues in the art.

SUMMARY OF THE INVENTION

In view of the above-mentioned problems of the prior art, the present invention provides a speaker, including: a base having a groove; a tube received in the groove, the tube having a first end corresponding to a bottom portion of the groove and a second end opposing the first end; a magnet disposed on the bottom portion of the groove and received in the tube; a washer installed on the second end of the tube; a first ring-shaped body sleeved on an outer side of the tube, received in the groove, and disposed between the first end of the tube and the washer; and a second ring-shaped body connected to an edge of the first ring-shaped body and mounted around a wall surface of the groove.

In an embodiment, the second ring-shaped body is in the shape of a flat plate, and has an inner ring-shaped plate, an outer ring-shaped plate, and a connection segment connected between the inner ring-shaped plate and the outer ring-shaped plate.

In another embodiment, the second ring-shaped body is embedded in a wall surface of a rim of the groove, and is disposed between the washer and the first ring-shaped body.

In yet another embodiment, the connection segment of the second ring-shaped body is in the shape of a curved line.

It is thus known from the above that the speaker according to the present invention, through the installation of the second ring-shaped body, has a low-frequency effect and peak power that are greatly improved and displays sound that suffers less distortion.

BRIEF DESCRIPTION OF DRAWINGS

The invention can be more fully understood by reading the following detailed description of the preferred embodiments, with reference made to the accompanying drawings, wherein:

FIG. 2(*a*) is a top view of a second ring-shaped body of the speaker shown in FIG. 2;

FIGS. 3' and 3" show other embodiments of FIG. 3; and

DETAILED DESCRIPTION OF THE INVENTION

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1:
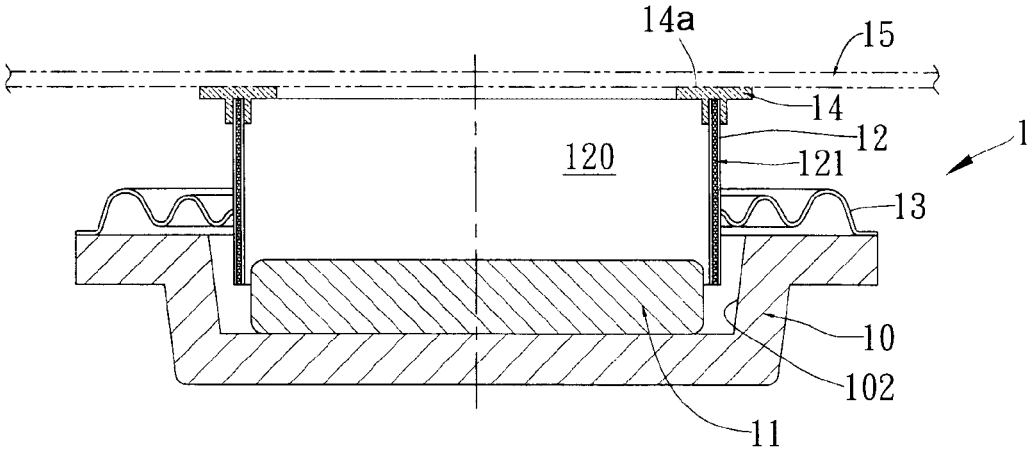
FIG. 1 (PRIOR ART)
FIG. 1 is a schematic diagram of a flat panel speaker according to the prior art.
Figure 2:
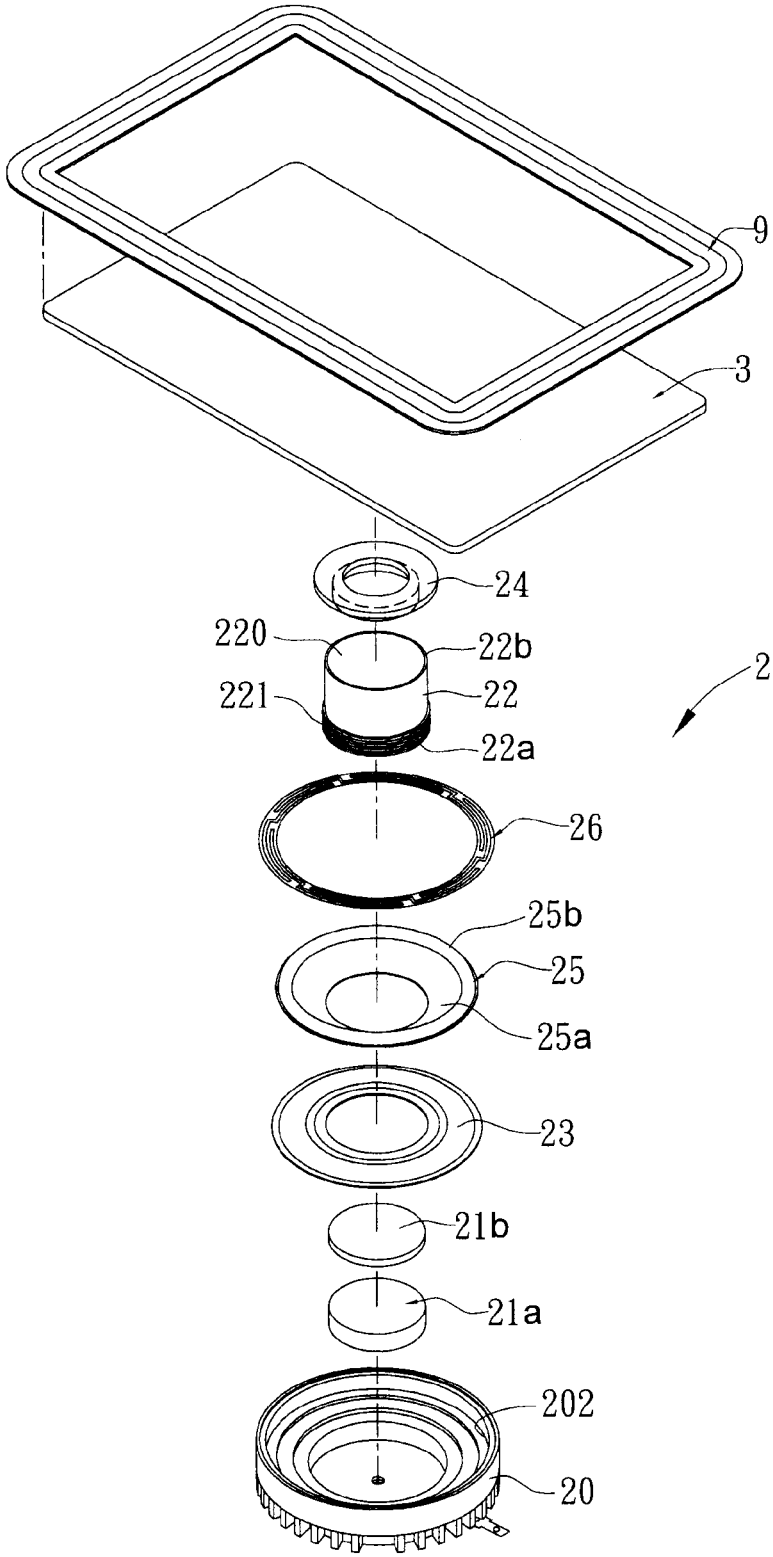
FIG. 2 is an exploded view of a speaker of an embodiment according to the present invention.
Figure 2A:
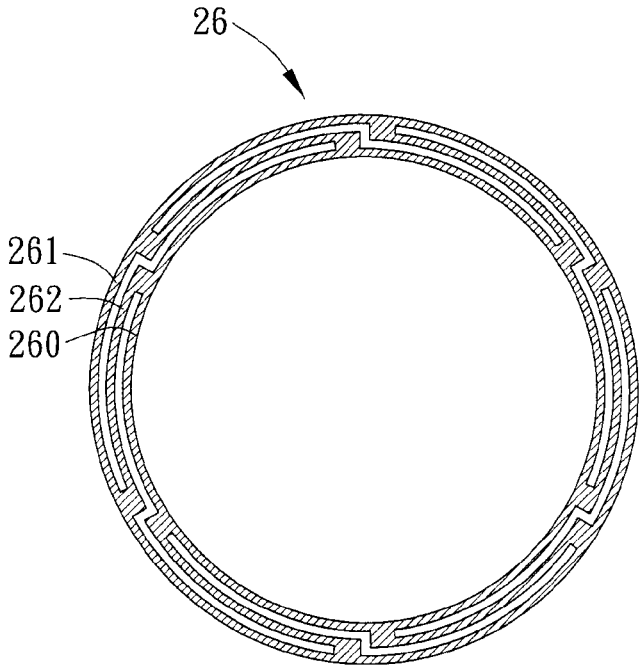
Figure 3:
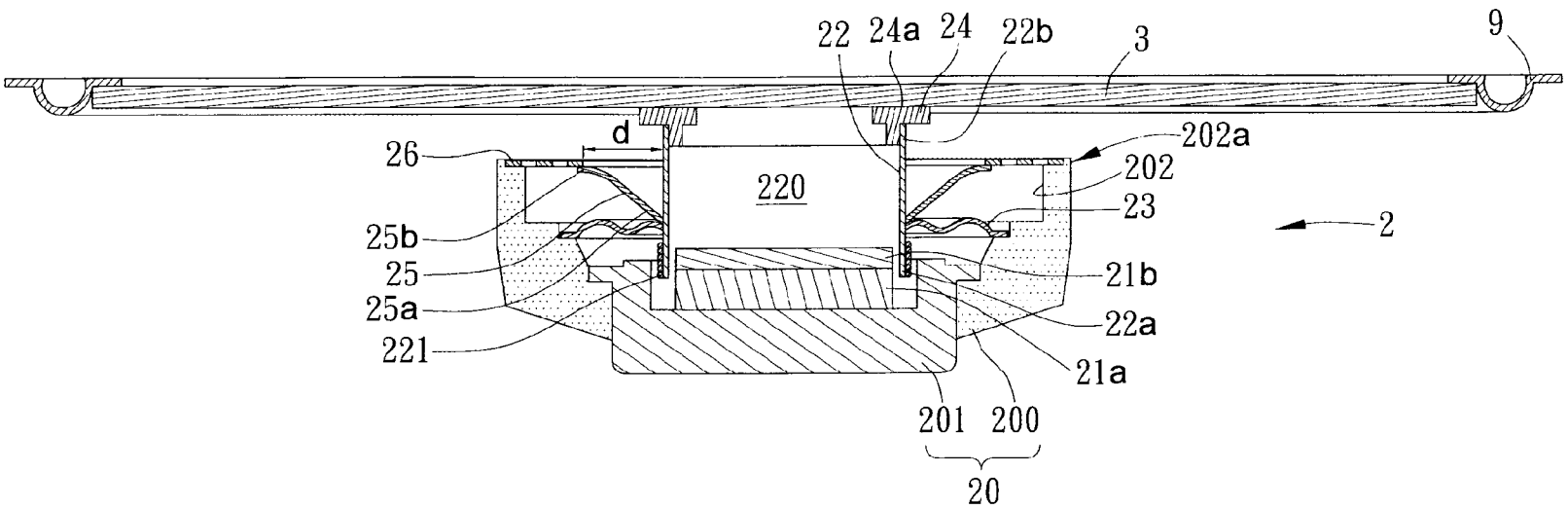
FIG. 3 is a cross-sectional view of the speaker shown in FIG. 2 combined with a plate body and a frame body.
Figure 3:
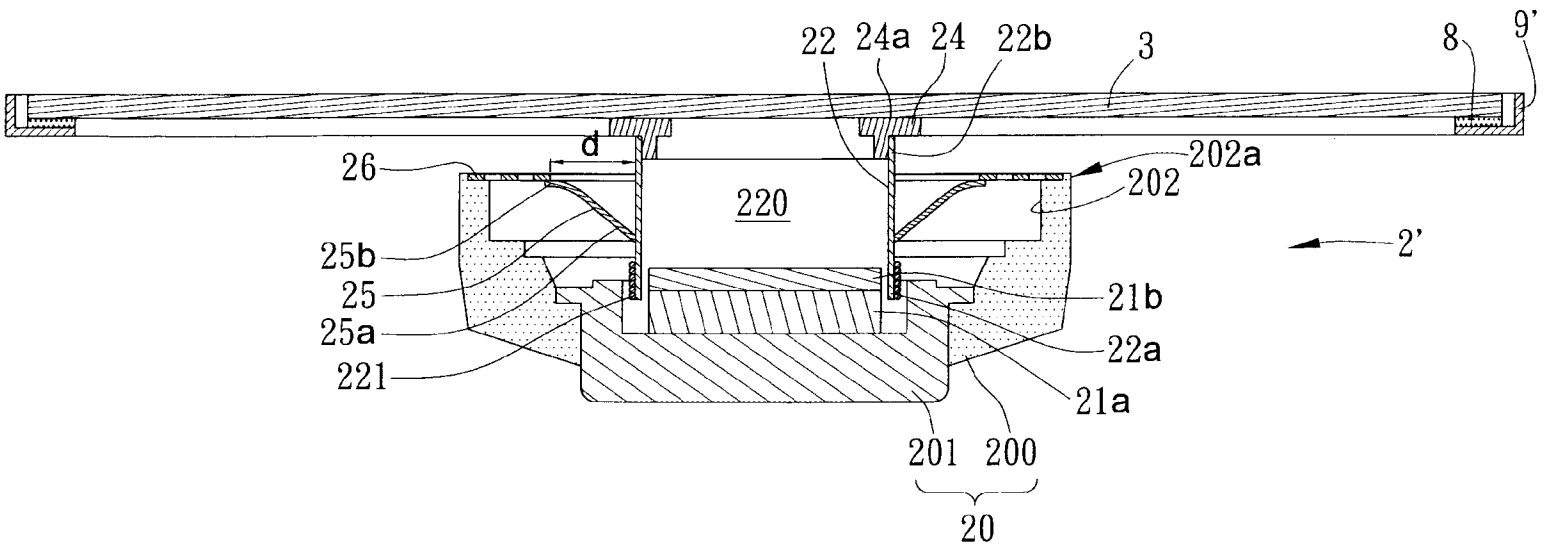

Referring to FIGS. 2 and 3, a speaker 2 according to the present invention is shown. The speaker 2 has a base 20 having a groove 202, a tube 22 received in the groove 202, a magnet 21*a* and a metal plate 21*b* disposed in the tube 22, a bracing component 23 and a first ring-shaped body 25 both mounted on an outer side of the tube 22 and received in the groove 202, a washer 24 disposed on the tube 22, and a second ring-shaped body 26 disposed on the groove 202.

The base 20 has a housing 200 and a metal block 201 embedded in a bottom portion of the housing 200. The metal block 201 acts as a bottom portion of the groove 202. In an embodiment, the base 20 may have other structures.

The tube 22 has a first end 22*a* (i.e., a bottom end in an embodiment) corresponding to the bottom portion of the groove 202, a second end 22*b* (i.e., a top end in the embodiment) opposing the first end 22*a*, and a through hole 220 communicating the first end 22*a* with the second end 22*b*. A plurality of coils 221 wind around the outer side on a bottom portion of the tube 22 (near the first end 22*a*). In an embodiment, the first end 22*a* of the tube 22 is spaced from the bottom portion of the groove 202 at an interval, and the second end 22*b* of the tube 22 protrudes from a rim of the groove 202.

The magnet 21*a* is disposed on the bottom portion of the groove 202 and in the through hole 220.

The metal plate 21*b* is received in the through hole 220 and disposed on a portion of the magnet 21*a* corresponding to the coil 221.

The bracing component 23 is a ring-shaped body sleeved on the outer side of the tube 22 above the coils 221, without pressing surfaces of the coils 221. The bracing component 23 has an outer edge connected to a wall surface of the housing 200 of the groove 202, for bracing the tube 22. The bracing component 23 has a wave-shaped cross section, but is not limited thereto.

The first ring-shaped body 25 has a first end portion 25*a* (acting as a bottom end portion in an embodiment) and a second end portion 25*b* (acting as a top end portion in the embodiment) opposing the first end portion 25*a*. The first end portion 25*a* props against the bracing component 23 and extends toward the second end portion 25*b*. The first ring-shaped body 25 thus has a plurality of rings with increasing radiuses, from bottom to top. The second end portion 25*b* has a cross section in the shape of a curved line, but is not limited thereto.

In an embodiment, the washer 24 may be mounted and fixed to the second end 22*b* of the tube 22, and the first ring-shaped body 25 is thus disposed between the bracing component 23 and the washer 24. The washer 24 may have a shape in accordance with the requirements for the speaker. In an embodiment, the washer 24 has a top surface that is a flat driving surface 24*a*, as shown in FIG. 3.

The second ring-shaped body 26 is connected to the second end portion 25*b* of the first ring-shaped body 25, so as to be corresponding to the groove 202 for being coupled to the wall surface of the rim 202*a* of the groove 202, as shown in FIG. 3, and disposed to surround the outer side of the tube 22. The second ring-shaped body 26 is disposed between the washer 24 and the first ring-shaped body 25.

In an embodiment, as shown in FIG. 2(*a*) the second ring-shaped body 26 is in the shape of a flat plate, and has an inner ring-shaped plate 260, an outer ring-shaped plate 261, and a plurality of connection segments 262 connected between the inner ring-shaped plate 260 and the outer ring-shaped plate 261. Any two adjacent connection segments 262 are spaced from each other at an interval. The connection segment 262 is in the shape of a curved line, but is not limited thereto. In an embodiment, the inner ring-shaped plate 260, the outer ring-shaped plate 261 and the connection segment 262 are formed integrally.

As shown in FIG. 3, an interval d is formed between the inner ring-shaped plate 260 and the tube 22 so that the second ring-shaped body 26 is not in contact with the tube 22.

In an embodiment, the second ring-shaped body 26 may be made of metal, plastic or composite material.

In an embodiment, the second ring-shaped body 26 is in the shape of a flat plate.

In use, the washer 24 of the speaker 2 is disposed on a plate body 3 that acts as a vibration plate, and then a frame body 9 is fixed to an edge of the plate body 3. In an embodiment, the frame body 9 has a cross section in the shape of a semi-circle (e.g., Ω) or a straight line.

A signal source generates a signal, which is amplified by an amplifier (not shown) and output to the coils 221 in the speaker 2. According to Ampere's right hand rule, a magnetic field is generated after the coils 221 receive the amplified signal. The magnetic field interacts with a constant magnetic field of the magnet 21*a*. As a result, the tube 22 moves back and forth relative to the magnet 21*a*, the first ring-shaped body 25 and the washer 24 are driven to move, and the driving surface 24*a* of the washer 24 drives the plate body 3 to move, to vibrate the air to generate medium- or high-frequency sound.

Through the shape design of the second ring-shaped body 26, when the tube 22 moves back and forth relative to the magnet 21 a, the second end portion 25*b* of the first ring-shaped body 25 drives the second ring-shaped body 26 to vibrate the air. As a result, the plate body 3 generates low-frequency sound with improved tone quality. Therefore, the low-frequency effect thus generated and peak power are greatly improved.

The speaker 2 according to the present invention is installed in a variety of amplifiers. Thus, the amplifiers can generate the low-frequency effect as required, without further being improved. Therefore, the amplifiers have a low manufacturing cost.

Since the first ring-shaped body 25 has less quality inertia, the sound sensitivity of the conventional flat panel speaker is improved effectively, and the problem that the sound quality is different at different positions where the plate body 3 is connected is solved.

The first ring-shaped body 25 and the second ring-shaped body 26 can combine with the bracing component 23 to support the tube 22, to prevent the moving tube 22 from generating an oblique phenomenon. Alternatively, as shown in FIG. 3', the speaker 2' does not have the bracing component 23 installed, and the first ring-shaped body 25 and the second ring-shaped body 26 thus support the tube 2, to prevent the moving tube 22 from generating the oblique phenomenon. Therefore, in vibration the tube 22 and the coils 221 may move linearly, up and down vertically, and the sound thus generated suffers from less distortion.

As shown in FIG. 3', the frame body 9' may be in the shape of a groove, and is installed on a bottom side of an edge of the plate body 3 by an adhering material 8 such as a twin adhesive. As shown in FIG. 3", the frame body 9" may have a flat surface, and is installed on a top side of the edge of the plate body 3 by the adhering material 8 such as the twin adhesive.

Figure 4:
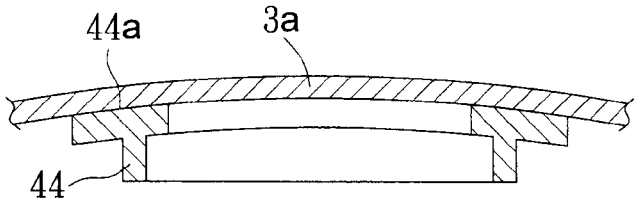
FIG. 4-6 show cross-sectional views of a speaker combined with a washer and a plate body of embodiments according to the present invention.
Figure 5:
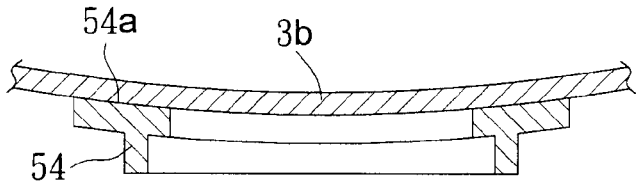
Figure 6:
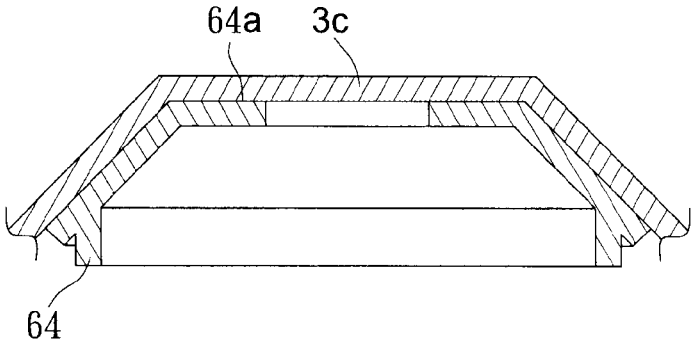

Referring to FIGS. 4-6, different aspects of the washer and plate body are provided. As such, different types of speakers are formed, and can be applied to a variety of amplifiers.

As shown in FIG. 4, the driving surface 44*a* of the washer 44 is convex, and the plate body 3*a* corresponds in shape to the driving surface 44*a*.

As shown in FIG. 5, the driving surface 54*a* of the washer 54 is concave, and the plate body 3*b* corresponds in shape to the driving surface 54*a*.

As shown in FIG. 6, the driving surface 64*a* of the washer 64 has a trapezoid cross section, and the plate body 3*c* corresponds in shape to the driving surface 64*a*.

In sum, the speaker according to the present invention comprises the first and second ring-shaped bodies. Because of the structure shape of the second ring-shaped body, when the tube drives the first ring-shaped body to move the second ring-shaped body, the second ring-shaped body vibrates and transmits tone quality that the low-frequency needs. As a result, the low-frequency effect and peak power are greatly improved. Therefore, the speaker of the present invention can transmit the tone quality not only to the medium-frequency and high-frequency, but also to the low-frequency, so as to achieve the objective of improving the tone quality.

The speaker of the present invention can be applied to a variety of amplifiers, and the amplifiers do not have their outer structures modified for the improvement of the low-frequency. Therefore, the amplifiers have low manufacturing cost.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A speaker, comprising:

a base having a groove;

a tube received in the groove, the tube having a first end corresponding to a bottom portion of the groove and a second end opposing the first end;

a magnet disposed on the bottom portion of the groove and received in the tube;

a washer installed on the second end of the tube;

a first ring-shaped body sleeved on an outer side of the tube, received in the groove, and disposed between the first end of the tube and the washer; and a second ring-shaped body connected to an edge of the first ring-shaped body and mounted around a wall surface of the groove, the second ring-shaped body being in a shape of a flat plate and having an inner ring-shaped plate, an outer ring-shaped plate, and a connection segment connected between the inner ring-shaped plate and the outer ring-shaped plate, wherein when the tube drives the first ring-shaped body to move the second ring-shaped body, the second ring-shaped body vibrates and generates low-frequency sound with improved tone quality.

2. The speaker of claim 1, further comprising a coil winding around the outer side of the tube.

3. The speaker of claim 1, wherein the first ring-shaped body includes a second end portion connected to the second ring-shaped body, and a first end portion opposing the second end portion and extending toward the second end portion.

4. The speaker of claim 1, wherein the washer includes a driving surface that is in contact with a plate body when the washer is in movement.

5. The speaker of claim 1, wherein the second ring-shaped body is coupled to a wall surface of a rim of the groove.

6. The speaker of claim 1, wherein the second ring-shaped body is disposed between the washer and the first ring-shaped body.

7. The speaker of claim 1, wherein the connection segment is in a shape of a curved line.

8. The speaker of claim 1, further comprising a metal plate disposed on the magnet and received in the tube.

9. The speaker of claim 1, further comprising a bracing component mounted on the outer side of the tube and having an outer edge connected to the wall surface of the groove between the first end of the tube and the first ring-shaped body.

* * * * *